United States Patent [19]

Nagato

[11] Patent Number: 4,589,917

[45] Date of Patent: May 20, 1986

[54] DECORATIVE GOLDEN SINTERED ALLOY

[75] Inventor: Yoshio Nagato, Kokubu, Japan

[73] Assignee: Kyocera Corporation, Japan

[21] Appl. No.: 634,621

[22] Filed: Jul. 26, 1984

[30] Foreign Application Priority Data

Jul. 28, 1983 [JP] Japan ..... 58-139117

[51] Int. Cl.[4] ..... C22C 29/04

[52] U.S. Cl. ..... 75/238; 75/240

[58] Field of Search ..... 75/240, 238; 419/13, 419/17

[56] References Cited

U.S. PATENT DOCUMENTS

| | | | |
|---|---|---|---|
| 3,409,419 | 11/1968 | Yates | 419/13 |
| 3,669,695 | 6/1972 | Iler | 419/13 |
| 4,422,874 | 12/1983 | Nishimura et al. | 75/238 |
| 4,514,224 | 4/1985 | Nishigaki | 75/238 |

FOREIGN PATENT DOCUMENTS

| | | |
|---|---|---|
| 108006 | 9/1978 | Japan . |
| 134535 | 8/1982 | Japan . |
| 61252 | 4/1983 | Japan . |
| 136743 | 8/1983 | Japan . |

*Primary Examiner*—John F. Terapane
*Assistant Examiner*—Anne Brookes
*Attorney, Agent, or Firm*—Spensley Horn Jubas & Lubitz

[57] ABSTRACT

Disclosed is a decorative golden sintered alloy which comprises a sintered body of a mixture comprising 51 to 98% by weight of titanium nitride, 1 to 19% by weight of chromium carbide and 1 to 30% by weight of nickel, wherein the titanium nitride is present in the dispersed phase of particles and nickel containing chromium in the form of an alloy is present in the phase of a binder.

This sintered alloy has an excellent golden color and gloss and has an excellent combination of corrosion resistance, strength and hardness.

4 Claims, No Drawings

DECORATIVE GOLDEN SINTERED ALLOY

BACKGROUND OF THE INVENTION (1) Field of the Invention

The present invention relates to an improvement in a decorative golden stintered alloy composed mainly of titanium nitride (TiN).

(2) Description of the Prior Art

Sintered alloys comprising TiN as the main component and a binder metal such as Co or Ni are widely used as decorative members because they have a golden color and are excellent in the hardness and strength.

Sintering of TiN is very difficult and in order to obtain a sintered product having a high strength, a binder metal such as mentioned above is used as the sintering aid.

However, since the sintering aid is a metal element, corrosion of the metal component present in the sintered alloy is advanced and discoloration is caused by sweat or the like, and the color of the decorative member is degraded.

Moreover, the above-mentioned sintering aid, especially a metal of the iron group, is poor in the wettability with TiN, and many voids appear throughout the crystal and grain boundary, and even if mirror polishing is carried out, a deep mirror surface can hardly be obtained.

SUMMARY OF THE INVENTION

It was found that when chromium carbide is selected among various carbides and nickel is selected among metal elements and if these components are combined in limited amounts with titanium nitride and sintering is then carried out, the above-mentioned defects of the conventional technique are completely eliminated and an excellent golden sintered alloy is obtained.

It is therefore a primary object of the present invention to provide a decorative golden sintered alloy which is excellent in the corrosion resistance and on which a deep and smooth golden mirror surface can be produced.

More specifically, in accordance with the present invention, there is provided a decorative golden sintered alloy which comprises a sintered body of a mixture comprising 51 to 98% by weight of titanium nitride, 1 to 19% by weight of chromium carbide and 1 to 30% by weight of nickel, wherein the titanium nitride is present in the dispersed phase of particles and nickel containing chromium in the form of an alloy is present in the phase of a binder.

DETAILED DESCRIPTION OF THE INVENTION

The sintered alloy of the present invention is in agreement with the conventional alloys in the point where titanium nitride (TiN) is the main component, but the sintered alloy of the present invention is characteristic over the conventional techniques in that chromium carbide is selected among carbides and nickel is selected among binder metals, and that chromium carbide is used in an amount of 1 to 19% by weight, preferably 3 to 15% by weight, based on the three components, and nickel is incorporated in an amount of 1 to 30% by weight, preferably 5 to 20% by weight, based on the three components.

In the preparation of the sintered alloy of the present invention, nickel as the binder metal is melted and sintering is advanced in this state. However, as pointed out hereinbefore, TiN is poor in the wettability with a molten metal, and many pores are formed in the obtained sintered body and dents are formed in the mirror surface, with the result that the surface gloss is dull and dark. Moreover, the corrosion of the metal is readily advanced because of a local cell formed between the binder metal and the TiN particles.

Chromium carbide used in the present invention exerts a function of prominently improving the wettability of the surface of titanium nitride particles with the molten metal and reacts with the molten metal to form a nickel-chromium alloy excellent in the corrosion resistance in the binder metal phase. Therefore, according to the present invention, a sintered body having a much reduced pore content can be formed and a smooth and deep mirror surface can be formed, and the corrosion resistance of the sintered body is prominently improved. In view of formation of a nickel-chromium alloy phase excellent in the corrosion resistance, it is important that nickel should be used as the binder metal.

The fact that the sintered alloy of the present invention has a micro-structure as described above can easily be confirmed by the analysis using an X-ray microanalyzer.

In the sintered alloy, that is, cermet, of the present invention, titanium nitride is present as the dispersed phase, and the nickel metal is present as the binder phase, that is, the continuous phase. Titanium nitride ordinarily has a crystal size of 3 to 4 $\mu$m. Chromium carbide ($Cr_3C_2$) forms a solid solution while all the chromium atoms in $Cr_3C_2$ replace the Ni atoms in the Ni crystal throughout the Ni grain boundary and all the carbon atoms in $Cr_3C_2$ is included into the Ni crystal. If carbon atoms are thus included in the crystal, the melting point of the Ni-binder phase is reduced and there can be attained an effect of lowering the sintering temperature.

It is considered that the reason why the pore content is drastically reduced in the sintered alloy of the present invention is that the wettability of the Ni-binder phase having the above-mentioned structure is improved and the sintering temperature is lowered.

As the chromium carbide, one having a composition of $Cr_3C_2$ is most advantageously used, but other known compositions such as $Cr_7C_3$ and $Cr_{23}C_6$ may be used singly or in the form of a mixture.

It is important that the above-mentioned three components should be used in specific amounts. If the amount incorporated of chromium carbide is smaller than 1 % by weight, the wettability of TiN with the molten metal is not improved, and the corrosion resistance is not highly improved. On the other hand, if the amount incorporated of chromium carbide exceeds 19% by weight, the sintered body becomes reddish and is not suitable as a golden decorative member. If the amount incorporated of Ni is smaller than 1% by weight, the sintering property is reduced, and a dense sintered body cannot be obtained and the strength is drastically reduced. If the amount incorporated of Ni exceeds 30% by weight, the corrosion resistance is reduced.

It is preferred that TiN as the main component be contained in the sintered body in an amount of at least 51% by weight. If the amount of TiN is smaller than 51% by weight, the sintered body has a dull golden color and is not suitable as a golden decorative member.

It is especially preferred that the TiN content in the sintered body be at least 65% by weight. The color of the final sintered alloy can be adjusted to a desirable color by changing the mixing ratios of the three components in the above-mentioned range.

composition of human sweat was prepared and the sample was immersed in this artificial sweat, and the salt spray test (Japanese Industrial Standard Z-2371) in which a saline solution (4% W/V) was sprayed in the form of the mist to the sample.

TABLE 1

| Sample No. | Mixing Ratios (% by weight) TiN | $Cr_3C_2$ | Ni | Apparent Density (g/cc) | Transverse Rupture Strength ($Kg/mm^2$) | Hardness HV ($Kg/mm^2$) | Corrosion Resistance | Color |
|---|---|---|---|---|---|---|---|---|
| 1* | 94.5 | 0.5 | 5 | 5.48 | 95 | 1050 | bad | golden |
| 2* | 93.6 | 6 | 0.4 | 5.40 | 60 | 1100 | good | golden |
| 3 | 90 | 5 | 5 | 5.59 | 100 | 1100 | good | golden |
| 4* | 90 | | 10 | 5.64 | 100 | 1000 | bad | golden |
| 5 | 80 | 10 | 10 | 5.78 | 120 | 1050 | good | slightly reddish golden |
| 6 | 80 | 15 | 5 | 5.71 | 105 | 1150 | good | slightly reddish golden |
| 7 | 80 | 5 | 15 | 5.85 | 125 | 1000 | good | golden |
| 8 | 60 | 17 | 23 | 6.20 | 125 | 1050 | good | slightly reddish golden |
| 9* | 60 | 30 | 10 | 6.00 | 110 | 1100 | good | reddish golden |
| 10* | 55 | 5 | 40 | 6.53 | 125 | 900 | bad | slightly reddish golden |

Note
*outside the scope of the present invention

The sintered alloy of the present invention contains the above-mentioned three components as indispensable components, but it may contain other components. For example, a part of chromium carbide may be replaced by a minor amount of other carbide, for example, niobium carbide, and a part of nickel may be replaced by other binder metal, for example, cobalt.

The particle size of each of the starting TiN, $Cr_3C_2$ and Ni powders is smaller than 2.0 μm, preferably smaller than 1.0 μm.

The process for preparing the sintered alloy of the present invention comprises adding $Cr_3C_2$ and Ni to the starting TiN powder to form a homogeneous mixture, compression-molding the mixture and sintering the molded mixture. If sintering is carried out in a furnace of a non-oxidizing atmosphere such as nitrogen or argon or a vacuum furnace ($10^{-2}$ to $10^{-5}$ Torr) at a temperature of 1400° to 1700° C., a decorative golden sintered alloy having a high corrosion resistance and a smooth and deep mirror surface can be obtained.

The present invention will now be described with reference to the following examples that by no means limit the scope of the invention.

EXAMPLE

The starting powders were mixed and pulverized at ratios shown in Table 1 in acetone for about 68B hours. The mixture was dried and paraffin was added in an amount of 4% by weight to the mixture. The mixture was compression-molded under 1.5 ton/$cm^2$. The binder was removed from the molded mixture and the molded mixture was sintered in a vacuum furnace under $10^{-4}$ Torr at 1550° C. for 1 hour.

The obtained sintered body was polished, and the color, transverse rupture strength, Vickers hardness (Hv) and corrosion resistance were tested.

The transverse rupture strength was measured according to the three-point bending method of Japanese Industrial Standard R-1601. The Vickers hardness was measured according to the method of Japanese Industrial Standard Z-2244. The corrosion resistance was determined according to the sweat resistance test method where an artificial sweat having a standard In connection with the corrosion resistance, similar results were obtained in both the sweat resistance test and the salt spray test. In Table 1, "good" indicates that neither discoloration nor corrosion was caused and the sample was a decorative member where the color was not degraded, and "bad" indicates that both the discoloration and corrosion were caused, the color was gradually degraded and the sample was not suitable as a decorative member.

From the results shown in Table 1, it is seen that each of samples 3, 5, 6, 7 and 8 was a golden sintered alloy being excellent in the corrosion resistance and having high hardness and strength suitable for decorative applications. Furthermore, it is seen that if each of these samples was polished, a smooth and deep golden mirror surface was produced and the sample was very excellent as a golden decorative member.

In contrast, it is seen that sample 2 was poor in the strength and sample 10 was poor in the corrosion resistance. Moreover, it is seen that sample 1 was poor in the corrosion resistance and sample 9 had a strongly reddish golden color, and each sample was not suitable as a golden decorative member.

Furthermore, in sample 4 comprising Ni alone as the sintering aid, discoloration or corrosion was observed and many voids were found on the mirror surface formed by polishing and no smooth and deep mirror surface was produced.

COMPARATIVE EXAMPLE

A sintered alloy was prepared in the same manner as described in the Example except that Ni was incorporated in an amount of 5% by weight and a carbide shown in Table 2 was incorporated in an amount of 5% by weight.

The obtained sintered alloy was tested in the same manner as described in the Example. The obtained results are shown in Table 2. Incidentally, in the column "Mirror Surface", "good" indicates that when the mirror surface was observed by a microscope, no defect was found, and "bad" indicates that the presence of pores on the surface was observed by a microscope and the surface gloss was dull when the surface was observed with the naked eye.

TABLE 2

| Sample No. | Composition (% by weight) TiN | Ni | Carbide | Apparent Density (g/cc) | Transverse Rupture Strength ($kg/mm^2$) | Hardness ($Kg/mm^2$) | Mirror Surface |
|---|---|---|---|---|---|---|---|
| 1 | 90 | 5 | $Mo_2C$, 5 | 5.50 | 40 | measurement impossible | bad |
| 2 | 90 | 5 | WC, 5 | 5.60 | 30 | measurement impossible | bad |
| 3 | 90 | 5 | TaC, 5 | 5.66 | 70 | 1000 | bad |
| 4 | 90 | 5 | $Cr_3C_2$, 5 | 5.60 | 100 | 1100 | good |
| 5 | 87.5 | 7.5 | $Cr_3C_2$, 5 | 5.63 | 115 | 1050 | good |

As is apparent from the foregoing description, the decorative golden sintered alloy of the present invention has hardness and strength suitable for decorative applications and is improved over the conventional golden alloys in the corrosion resistance, and a smooth and deep golden mirror surface can be produced on the sintered alloy of the present invention by polishing. Furthermore, the sintered alloy of the present invention is not corroded or flawed over a long period. Accordingly, the sintered alloy of the present invention is valuable as a decorative member or article such as a wall material, a watch case, a brooch, a commemorative medal, a button, a bracelet, a ring or a pendant.

I claim:

1. A decorative gold-colored sintered alloy consisting essentially of:

51 to 98% by weight of titanium nitride;

1 to 19% by weight of chromium carbide; and 1 to 30% by weight of nickel, wherein the titanium nitride forms a dispersed phase or particles and the nickel containing chromium in the form of an alloy forms a binder.

2. A sintered alloy as set forth in claim 1, consisting essentially of:

65 to 92% by weight of titanium nitride;

3 to 15% by weight of chromium carbide; and 5 to 20% by weight of nickel.

3. A gold-colored sintered alloy consisting of:

51 to 98% by weight of titanium nitride;

1 to 19% by weight of chromium carbide; and 1 to 30% by weight of nickel.

4. A gold-colored sintered alloy consisting of:

65 to 92% by weight of titanium nitride;

3 to 15% by weight of chromium carbide; and 5 to 20% by weight of nickel.

* * * * *